US008999123B2

(12) United States Patent
Bernstein et al.

(10) Patent No.: US 8,999,123 B2
(45) Date of Patent: Apr. 7, 2015

(54) ALKALI-METAL GENERATOR AND ABSORBER

(75) Inventors: Jonathan J. Bernstein, Medfield, MA (US); Mark J. Mescher, West Newton, MA (US); William L. Robbins, Newton Center, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 595 days.

(21) Appl. No.: 12/758,700

(22) Filed: Apr. 12, 2010

(65) Prior Publication Data

US 2011/0247942 A1 Oct. 13, 2011

(51) Int. Cl.
*C25C 3/02* (2006.01)
*C25C 1/02* (2006.01)
*C22B 26/10* (2006.01)

(52) U.S. Cl.
CPC .. *C25C 1/02* (2013.01); *C22B 26/10* (2013.01)

(58) Field of Classification Search
CPC ..... C25C 3/02
USPC ..... 204/242; 205/402, 405, 406
See application file for complete search history.

(56) References Cited

U.S. PATENT DOCUMENTS 3,439,544 A 4/1969 Boldridge
3,542,604 A 11/1970 Arrance et al.
4,744,954 A 5/1988 Campbell et al.
4,783,595 A 11/1988 Seidl
5,521,389 A 5/1996 Kim
6,570,459 B1 5/2003 Nathanson et al.
6,610,440 B1 8/2003 LaFollette et al.
6,823,693 B1 11/2004 Hofmann et al.
6,900,702 B2 5/2005 Youngner et al.
7,030,704 B2 4/2006 White
7,058,111 B2 6/2006 Seiber
7,359,059 B2 4/2008 Lust et al.
2002/0139647 A1 10/2002 Bernstein
2003/0094379 A1 * 5/2003 Jacobson et al. ..... 205/406
2009/0095414 A1 4/2009 McBride
2009/0162750 A1 6/2009 Kawakami et al.
2009/0229648 A1 9/2009 Makansi
2009/0239096 A1 9/2009 Ukuma
2009/0322221 A1 12/2009 Makansi
2010/0003603 A1 1/2010 Chiang et al.
2010/0033255 A1 2/2010 Strabley et al.

OTHER PUBLICATIONS

Klemperer et al., "Vacuum Preparation of Pure Cesium by Electrolysis of Glass", J. Vac. Sci. Technology, vol. 13, No. 6, Nov./Dec. 1976, Copyright 1976 by the American Vacuum Society, pp. 1166-1174.
AlkaMax Information Sheet, 2008, SAES Getters Group, 2 pages.
Cattaneo et al., "AlkaMax SAES Solution for Alkali Metal Dispensing in OLED Display Manufacturing" AlkaMax Application Note vol. 1, May 2004, pp. 1-13.
Succi et al. "Atomic Absorption Evaporation Flow Rate Measurements of Alkali Metal Dispensers," Vacuum, Dec. 1985, Great Britain, vol. 35, No. 12, pp. 579-582.

(Continued)

*Primary Examiner* — Zulmariam Mendez
(74) *Attorney, Agent, or Firm* — Goodwin Procter LLP

(57) ABSTRACT

Electrodes are positioned substantially in contact with at least one surface of a solid to generate or absorb alkali metals when a voltage is applied between the electrodes.

15 Claims, 7 Drawing Sheets

(56) References Cited

OTHER PUBLICATIONS della Porta et al., "Alkali Metal Generation and Gas Evolution From Alkali Metal Dispensers," Research and Development Laboratories, 1968, S.A.E.S Getters S.p.A. Milan, Italy, pp. 246-254.

Murugavel et al., "Ion Transport Mechanism in Borate Glasses: Influence of Network Structure on Non-Arrhenius Conductivity," Physical Review B 76, Issue 18, id, 180202(R), 2007, 4 pages.

Ashton-Patton, "Properties of Mixed Alkali Germanate Glasses," A thesis submitted to the faculty of Alfred University, NY, Apr. 2008, 29 pages.

Gong et al., "Electrolytic Fabrication of Atomic Clock Cells," Review of Scientific Instruments 77, 076101, 2006, 3 pages.

Kim et al. "A New Solid-State Cesium Ion Source," J. Appl. Phys., vol. 67, No. 6, Mar. 15, 1990, pp. 2704-2710.

Kim et al. "Solid-State Cesium Ion Gun for Ion Beam Sputter Deposition," Rev. Sci. Instrum., vol. 63, No. 12, Dec. 1992, pp. 5671-5673.

* cited by examiner

ALKALI-METAL GENERATOR AND ABSORBER

STATEMENT REGARDING FEDERALLY SPONSORED RESEARCH OR DEVELOPMENT

This invention was made with government support awarded by the Defense Advanced Research Projects Agency ("DARPA") under Contract No. N66001-09-C-2057. The U.S. Government has certain rights in the invention.

FIELD OF THE INVENTION

In various embodiments, the present invention relates to devices, such as solid-state electrochemical devices, and methods for generating and/or absorbing alkali metals.

BACKGROUND

The alkali metals include lithium (Li), sodium (Na), potassium (K), rubidium (Rb), cesium (Cs), and francium (Fr), which are rarely found in elemental (i.e., atomic) form in nature. Each atom of an alkali metal has one electron in its outermost electron orbit (shell), and by relinquishing that electron a singly charged positive ion of an alkali metal is formed. Conversely, an alkali metal ion may be converted into a corresponding atom by receiving a single electron. In general, the alkali metals are extremely reactive and pyrophoric (i.e., they can ignite spontaneously in air), and they also react vigorously with water.

Although alkali metals in elemental form are rarely found in nature, and are generally difficult to store and handle in that form due to their high reactivity, these metals have significant uses in devices such as atomic clock systems, atomic magnetometers, gyroscopes, accelerometers, and cold atom cluster devices. For example, the hyperfine transitions of potassium, rubidium, and cesium can be used in setting frequency standards, which are typically required in highly accurate clocks. Therefore, it is often desirable to convert an alkali metal from a non-elemental form (e.g., as part of a compound or mixture that can be stored and handled relatively easily) into the corresponding elemental form.

Some methods for converting a non-elemental alkali metal into the corresponding elemental form involve chemical reactions. These reactions are generally thermally driven, requiring high temperature and applied energy. For example, the commercially available SAES alkali metal sources are typically run at 3 to 7 amps current and at a temperature of 400 to 700° C. These chemical reactions can also release unwanted or undesirable chemicals along with the desired alkali metal. For example, a chemical reaction may release oxygen, which can react with the alkali metal. Moreover, chemical reactions that release an alkali metal are generally irreversible and cannot later absorb the alkali metal.

Some systems, such as those employing thermoelectric hot/cold fingers, control alkali-metal vapor pressure by heating or cooling a reservoir of the elemental alkali. These systems typically require a small charge of elemental alkali metal, which is highly reactive. Finally, some conversion devices employ an electrochemical reaction, but generally require additional structures such as a liquid-salt anode and an ion-conducting wall of a chamber in which the alkali metal is produced. These devices generally operate at very high temperatures, typically in the range of 300° C. to 500° C., and require high voltages, such as 700V. Furthermore, the need to create an ion-conductive chamber wall usually makes manufacturing and operating these devices very difficult.

Therefore, there is a need for improved devices and methods of converting non-elemental alkali metals into their corresponding elemental form and for later absorbing the metals when they are no longer required.

SUMMARY

In various embodiments, the present invention provides devices and methods for generating alkali metals, i.e., converting non-elemental alkali metals into their corresponding elemental forms, and for absorbing alkali metals, i.e., converting elemental-form alkali metals into non-elemental forms. In certain embodiments, these devices and methods do not require very high temperature or power, and do not require chemicals other than compounds, mixtures, or glasses containing alkali metals. They also do not produce unwanted chemicals during the conversion processes.

In one embodiment, two electrodes are positioned substantially in contact with one or more surfaces of a solid, which can be a glass, a compound, or a mixture containing non-elemental-form alkali metal. For example, the solid can be a cesium-borate ($CsBO_3$) glass, a cesium-germanate glass, cesium silicate, or any glass containing alkali metals. Many glass-forming systems are well known, and the glass may contain borate, germanate, silicate, phosphate, alumina, and gallia groups in addition to the alkali metal. Other well-known glass-forming elements include carbon, tin, lead, nitrogen, arsenic, antimony, bismuth, sulfur, selenium and tellurium. Furthermore, multi-phase glass systems and glass ceramics may be used as a solid, as long as the alkali-containing phase forms a continuous path allowing electric-field-induced ion motion. Alkali-containing crystalline phases may also be used as a solid. In choosing the processes and materials used in forming an alkali-metal-containing solid, the ability to form a stable solid in which the alkali metal contained therein can have a high ionic mobility is typically important.

As used herein, the term "consists essentially of" precludes inclusion of additional components contributing to function, but allows for inclusion of components that do not so contribute. In addition, as used herein, an electrode "substantially in contact with" a surface of a solid means that at least a portion of the electrode directly contacts the surface, but that the electrode need not overlay or underlay the entire surface of the solid and/or may extend beyond such a surface. There need not be other materials including air or other gases, or vacuum, between the electrode and the surface of the solid. Positioning an electrode in this manner can be accomplished using relatively simple manufacturing processes, as opposed to when other materials must be positioned between the electrode and the surface of the solid. Moreover, the lack of additional materials between the electrode and the solid allows the solid to be efficiently heated (as described below), the current flow between two electrodes that have been so positioned may experience less resistance, and the release of unwanted chemicals may be avoided when the current flows between the electrodes. In some embodiments, a vacuum chamber wall need not be a part of such an alkali-metal generator. This results in a compact, light, and efficient alkali-metal generator that can be operated at reduced power and temperature compared to other alkali-metal generators.

The assembly of the electrodes and the solid can be placed in a chamber in which an alkali metal is to be produced or absorbed. In one embodiment, the electrodes are positioned such that at least a portion of a surface of the solid is exposed to the chamber. Then, when a sufficient DC voltage (e.g., 50 V) is applied between the electrodes, elemental-form alkali metal is released into the chamber through the exposed solid surface. By reversing the polarity of the applied voltage the process can be reversed, thereby absorbing elemental-form alkali metal within the chamber into the solid through the exposed surface. By heating the assembly to different temperature levels (e.g., to 25° C. or to 300° C.), the resistivity of the alkali containing material can be varied, and the device can be operated at different voltage levels.

Accordingly, in one aspect, embodiments of the invention feature a device for generating an alkali metal from, or absorbing an alkali metal into a solid that contains the alkali-metal in a non-elemental (e.g., ionic) form. The solid in the alkali-metal generating/absorbing device may be, for example, a glass, a glass-ceramic, a multi-phase glass, a compound, a mixture, or a crystalline solid. The device includes first and second electrodes positioned substantially in contact with at least one surface of the solid, and a driver for applying a voltage between the two electrodes to release ions of the alkali metal in the solid. At least a portion of the released ions may be converted into elemental form upon reaching one of the electrodes. In addition, at least one of the electrodes can be formed using an ion-injecting or ion-absorbing metal alloy or metal, such as copper or silver. The metals or alloys used to form the first and second electrodes can be different or, alternatively, the same metal or alloy can be used to form both electrodes.

In some embodiments, the first electrode is positioned substantially in contact with a top surface of the solid, and the second electrode is positioned substantially in contact with a bottom surface of the solid. The second electrode may be disposed as a layer on the bottom surface, while the first electrode may disposed in a pattern, such as a finger pattern, an interdigitated pattern, a ring-dot pattern, a mesh pattern, and/or a star pattern. Alternatively, the first electrode may also be disposed as a layer on the top surface. In other embodiments, the first and second electrodes can be disposed on a single surface of the solid in a pattern, for example an interdigitated pattern or a ring-dot pattern.

In some embodiments, the device further includes a heater for heating the solid. The device may additionally, or alternatively, include a chamber enclosing the solid and the first and second electrodes. The chamber can be a vacuum chamber, or it may contain an inert gas.

In a second aspect, embodiments of the invention feature a method for generating an alkali metal in a chamber. The method includes positioning an anode substantially in contact with a first surface of a solid containing an alkali metal in a non-elemental form, and positioning a cathode substantially in contact with a second surface of the solid. At least a portion of the second surface is exposed to the chamber. The method also includes the step of applying a voltage between the anode and cathode to release ions of the alkali metal in the solid. At least a portion of the released ions may be converted into elemental form upon reaching the second surface.

In some embodiments, the method further includes heating the solid. The first and second surfaces of the solid can be the same surface of the solid, i.e., the two electrodes may be disposed on the same surface of the solid.

In a third aspect, embodiments of the invention feature a method for generating an alkali metal in a chamber, including the steps of positioning an anode substantially in contact with a first surface of a solid containing an alkali metal in a non-elemental form, and positioning a cathode substantially in contact with a second surface of the solid. A voltage is applied between the anode and cathode to release ions of the alkali metal in the solid. A first fraction of the released ions forms a compound in the cathode, while a second fraction of the released ions are converted into elemental form and diffuse through the compound.

In a fourth aspect, embodiments of the invention feature a method for absorbing an alkali metal in a chamber, including the steps of positioning a cathode substantially in contact with a first surface of a solid containing an alkali metal in a non-elemental form, and positioning an anode substantially in contact with a second surface of the solid. At least a portion of the second surface may be exposed to the chamber. A voltage may be applied between the anode and cathode so that alkali metal in the chamber is received at the second surface of the solid and is converted into ions for absorption into the solid. Again, the first and second surfaces of the solid can be the same surface of the solid, i.e., the two electrodes may be disposed on the same surface of the solid.

In a fifth aspect, embodiments of the invention feature a method for absorbing an alkali metal in a chamber. The method includes positioning a cathode substantially in contact with a first surface of a solid containing an alkali metal in a non-elemental form, and positioning an anode substantially in contact with a second surface of the solid. A voltage may be applied between the anode and cathode so that a first fraction of elemental form alkali metal in the chamber is absorbed in the anode. Upon absorption, the alkali metal may react with the metal of the anode to form a compound therewith. Then, a second fraction of the elemental form alkali metal in the chamber diffuses through the compound, is converted into a non-elemental form, and may be absorbed in the solid.

These and other objects, along with advantages and features of the embodiments of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Figure 1A:
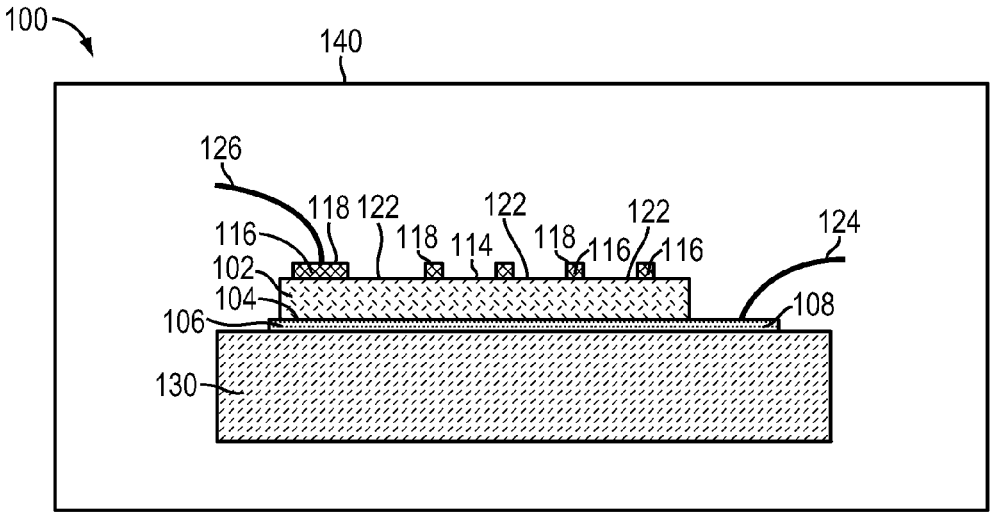
FIGS. 1A and 1B show side and top views, respectively, of one embodiment of an alkali-metal generating and absorbing device, which has electrodes positioned on two different surfaces of a solid.
Figure 1B:
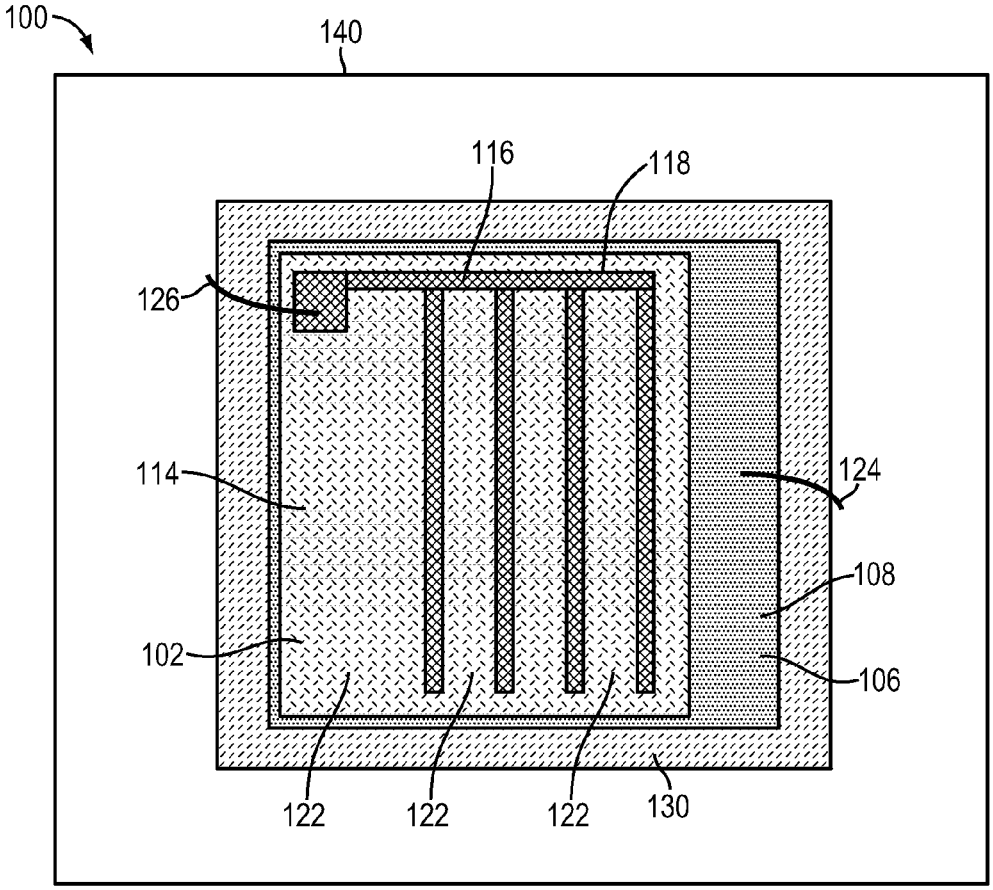

Side and top views of an alkali-metal generation/absorption device 100 according to one embodiment of the present invention are shown in FIGS. 1A and 1B, respectively. The device 100 includes a solid 102, such as a $CsBO_3$ glass 102, which contains cesium (Cs) in non-elemental form. Such a glass can be made using known processes such as forming a melt of $Cs_2O$ and $B_2O_3$, and quenching the melt by pouring it into a mold or using a roller quencher. Other starting ingredients such as carbonates can also be used, which lose $CO_2$ on heating. For ease of explanation, the device 100, and various other embodiments of the alkali-metal generation/absorption devices mentioned herein, are described to generate and/or absorb Cs. However, as will be understood by one of ordinary skill in the art, the device 100 and all other devices described herein may be employed with the same principles of operation to generate and/or absorb any of the alkali metals by choosing an appropriate solid 102 (i.e., a solid 102 containing the alkali metal of interest) and appropriate materials for the electrodes (described further below) that are in substantial contact with the solid 102. Moreover, although FIGS. 1A and 1B show the solid 102 to be brick-shaped, it should be understood that this for illustration only and that other shapes, such as an ovular solid or a circular disk, may be employed.

In one embodiment, a layer 106 of silver is positioned in contact with a bottom surface 104 of the solid 102 to form a first electrode 108. Known processes, such as evaporation, sputtering, electroplating, and screen printing, can be used to form the silver layer 106. In the illustrated device 100, the silver layer 106 is positioned in contact with substantially the entire bottom surface 104 of the solid 102. Another layer 116 of silver may be positioned on a top surface 114 of the solid 102 to form a second electrode 118. It should be understood, however, that the silver electrodes 108, 118 are shown for illustrative purposes only, and that the electrodes 108, 118 can be formed of other metals such as gold and copper, and of alloys of metals. In a preferred embodiment, silver or copper are used for layer 106, because these metals have a high mobility in many solids and they do not react with Cs in the elemental form. Moreover, each electrode can be formed from a different metal or metal alloy. As can seen in FIG. 1B, the silver layer 116 may be positioned in a finger pattern such that portions 122 of the top surface 114 of the solid 102 are not covered by the electrode 118. Wirebonds 124, 126 may be formed with the electrodes 108, 118, respectively. A power supply (not shown) can also be connected to the electrodes 108, 118 using the wirebonds 124, 126.

In one embodiment, the solid 102 and the electrodes 108, 118 are positioned on a ceramic board 130, and the assembly of these components is placed in a chamber 140. The ceramic board 130 may provide support to the solid 102 and electrodes 108, 118, and can also accommodate fixtures (not shown) such that the assembly of these components can be mounted inside the chamber 140. However, the solid 102 and the electrodes 108, 118 need not be positioned on a ceramic board 130. They may instead be mounted on a board coated with a layer of silver or copper, and/or a board made from other materials such as glass, glass-ceramic, or metal substrates preferably having a coefficient of thermal expansion (CTE) similar (e.g., within ±10% or, in some embodiments, within ±5%) to that of the alkali containing solid 102. A board having a similar CTE as the solid 102 it supports can accommodate the expansion of the solid 102 when it is heated (as described below). A CsBO3 glass can typically have a CTE of 11 ppm/° C., and a $ZrO_2$ ceramic or many steel alloys can have a similar CTE, and hence, may be used in creating a board. The solid 102 and the electrodes 108, 118 can also be directly positioned inside the chamber 140 without the use of a board 130.

One method of forming the solid 102 is to sinter a glass frit onto a substrate having a metal layer (e.g., silver or copper) on a surface of the substrate. The sintered metal layer can form the electrode 108. The electrode 118 can be formed using a shadow mask or some form of lithography which is well known in the arts of semiconductor or MEMS fabrication. In one embodiment, the ceramic board 130 includes a heater to heat the solid 102, as described below. Additionally, or alternatively, a separate heater (not shown) can be used to heat the solid 102 by positioning the heater below the ceramic board 130 or at another location in proximity to the solid 102.

The chamber 140 can be a vacuum chamber or a chamber containing an inert gas (e.g., argon), so that when Cs is released into the chamber 140 it does not react with another element. In FIGS. 1A and 1B, the chamber 140 is shown schematically as a cube. The chamber 140 may, however, have another shape, such as that of a sphere or a cylinder.

Figure 2A:
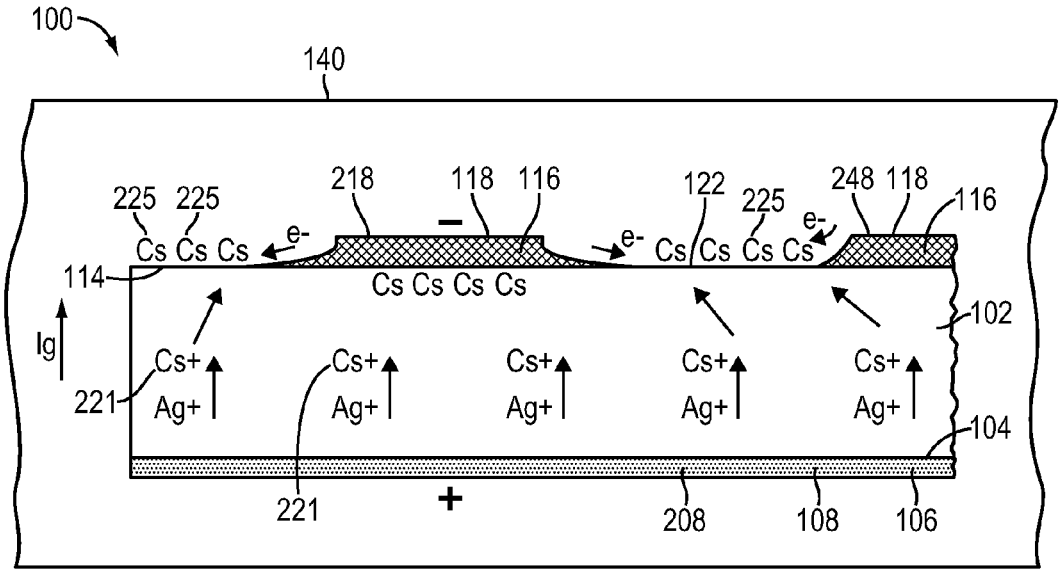
FIGS. 2A and 2B schematically depict exemplary operations of the device illustrated in FIGS. 1A and 1B.

In operation, and with reference now to FIG. 2A, the positive terminal of a power supply (not shown) may be connected to the electrode 108 and the negative terminal of the power supply may be connected to the electrode 118. Accordingly, the electrode 108 operates as an anode 208 and the electrode 118 operates as a cathode 218. When a voltage is applied between the electrodes 108, 118, the anode 208 releases silver ions, denoted as $Ag^+$, in the solid 102. This ionic current causes cesium ions ($Cs^+$ ions) 221 to move through the solid 102 toward a cathode finger 218. Upon arriving at the top surface 114 of the solid 102, a $Cs^+$ ion 221 can receive an electron, denoted as $e^-$, from a cathode finger 218 and be converted into a Cs atom 225 (i.e., Cs in elemental form). A fraction of the Cs atoms 225 that reach the portions 122 of the top surface 114 of the solid 102 are then released into the chamber 140.

In the chamber 140, a cold-atom cluster of the released Cs atoms may be formed using a magnetooptical-trap (MOT). A MOT generally includes coils and converging laser beams for confining and cooling atoms, thereby forming a cold atom cluster. Typically, a Cs cold atom cluster contains approximately $10^3$ to $10^7$ atoms, depending on the size of the MOT. Although the number of Cs atoms required to form a cold atom cluster is thus relatively few, far more Cs atoms may be required to "saturate" the vacuum chamber into which such a cluster is to be formed. The vacuum chamber walls typically can absorb or adsorb a certain number of monolayers of Cs, which can require a substantially greater number of Cs atoms than that required to form a cold atom cluster. However, once the chamber 140 is initially "saturated", an equilibrium may be reached and relatively few additional Cs atoms may be required to maintain the cold atom cluster. In fact, if the partial pressure of Cs inside the chamber becomes too high, it may be necessary to remove at least some Cs atoms from the chamber 140. The removal of alkali can be accomplished using graphite absorbers, but these absorbers constantly remove Cs, requiring the Cs generator to be much larger than would otherwise be necessary. Therefore, a bidirectional or reversible alkali generator/absorber, which can substantially eliminate the need for graphite absorbers and, as a consequence, decrease the total number of Cs atoms generated, is highly desirable.

The total number of $Cs^+$ ions 221 converted into Cs atoms 225 within a certain time period is proportional to the magnitude of the current flow, denoted as Ig, between the anode 208 and the cathode 218. If the device 100 operates at 100% efficiency, each electron in the current flow Ig is received by one $Cs^+$ ion 221, converting the ion into a Cs atom 225. Thus, at 100% efficiency, a current of magnitude 1 pA (which corresponds to electrons flowing at a rate of approximately $6.2\times10^6$ electrons/second) can correspond to conversion of $6.2\times10^6$ $Cs^+$ ions/sec into Cs atoms. As such, a current of 1 pA can produce a sufficient number of Cs atoms to populate a MOT within a few seconds of operation at 100% efficiency.

The current flow between the anode 208 and the cathode 218 depends on the resistivity of the solid 102, the electrode pattern, and the voltage applied between the anode 208 and the cathode 218. The resistivity of the solid 102 is an inherent property of the composition of the solid 102 and its microstructure, and is related to its temperature. For example, at 80° C. the resistivity of a cesium-borate ($CsBO_3$) glass (25 mole % $Cs_2O$) is approximately $3.5\times10^{13}$ ohm-cm. Therefore, a 3 mm×3 mm×0.5 mm $CsBO_3$ glass has a resistance of approximately $2\times10^{13}$ ohm. With such a glass, and with a voltage between the anode 208 and the cathode 218 of 50 V, current Ig is approximately 2.5 pA. This corresponds to the generation of approximately $1.55\times10^7$ Cs atoms/sec when the device 100 operates at 100% efficiency.

Thus, at 50 V and 80° C., the device 100 can populate a 1 mm diameter spherical MOT, requiring about 2 million Cs atoms, within approximately 0.13 seconds of operation at 100% efficiency. The device 100 may, however, operate at a reduced efficiency, i.e., each electron in current Ig may not be received by a $Cs^+$ ion 221, thereby requiring current flow to occur for a longer duration than that would be necessary at 100% efficiency. In addition, some Cs atoms may be trapped under the cathode and thus unable to vaporize from the surface. Typically, the operating efficiency of device 100 may vary from 5% to 80%. Even at 5% efficiency, however, at 50 V and 80° C. a device 100 can populate a MOT of 1 mm size within approximately 2.6 seconds of operation.

If the temperature of the solid 102 is increased, its resistivity decreases. Therefore, substantially the same magnitude of current can be achieved by applying a lower voltage when the solid's temperature is increased, for example by employing a heater. In FIGS. 1A and 1B, the ceramic board 130 may include an embedded heater. Alternatively, or additionally, other heaters may be positioned in proximity to the solid 102 and may be used to heat the solid 102. Said another way, if the temperature of the solid 102 is increased above 80° C., a MOT of a certain size can be populated with Cs atoms using a lower voltage in substantially the same time as that required using a 50 V power supply at 80° C. Alternatively, using a high temperature and a high voltage, a MOT of a given size can be populated in shorter duration, or a larger MOT can be populated in substantially the same time.

As described above, the resistivity of the solid 102 is an inherent property of the composition of the solid 102. Therefore, by using a different type of solid 102, such as a different type of glass (e.g., cesium-germanate or cesium silicate glass), which generally has a lower resistivity than cesium-borate glass at 25 mole % $Cs_2O$, a MOT of a certain size can be populated in a desirable or required time period using different combinations of reduced voltage and temperature values.

Figure 2B:
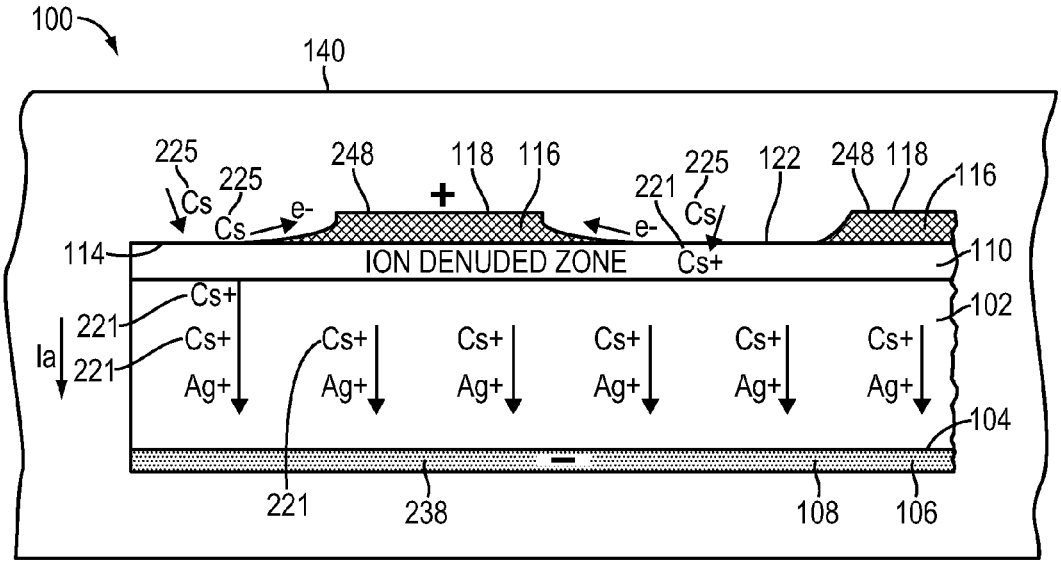

The device 100 can also be operated to absorb Cs atoms 225 present in the chamber 140, as illustrated in FIG. 2B. For example, Cs atoms may be absorbed by the device 100 when an excess of Cs is present in the chamber 140 and some of it must be removed. For the device 100 to be used as an absorber, the polarity of the electrodes 108, 118 is reversed, i.e., the electrode 108 is connected to the negative terminal of a power supply (not shown) and the electrode 118 is connected to the positive terminal of the power supply. Accordingly, the electrode 108 operates as a cathode 238 and the electrode 118 operates as an anode 248. Under this voltage polarity, a surface region 110 relatively denuded of cations (the ion-denuded zone) may be created which can absorb Cs.

Then, a Cs atom 225 in the chamber 140 is adsorbed on the top surface 114 of the solid 102, loses an electron e– through surface conduction to anode 248, and is converted into a $Cs^+$ ion 221. A fraction of the $Cs^+$ ions 221 are then absorbed into the solid 102 through the portions 122 of the top surface 114 that are exposed to the chamber 140, as illustrated in FIG. 1B. The absorbed $Cs^+$ ionic flow 221 causes silver ions ($Ag^+$) to move toward the cathode 238, causing current flow Ia between the anode 248 and the cathode 238. Thus, Cs atoms 225 in the chamber 140 are absorbed into the solid 102. As before, the rate of absorption of Cs atoms is determined by the operating efficiency of the device 100 and the magnitude of the current Ia, which depends on the voltage applied between the anode 248 and the cathode 238 and the resistivity of solid 102, as well as the rate of impingement of Cs atoms on the surface 114. As described above, the resistivity of the solid 102 depends on its composition, and is related to its temperature. Hence, the rate of absorption of Cs atoms can be controlled using a heater and/or by varying the voltage applied between the anode 248 and the cathode 238.

Figure 3A:
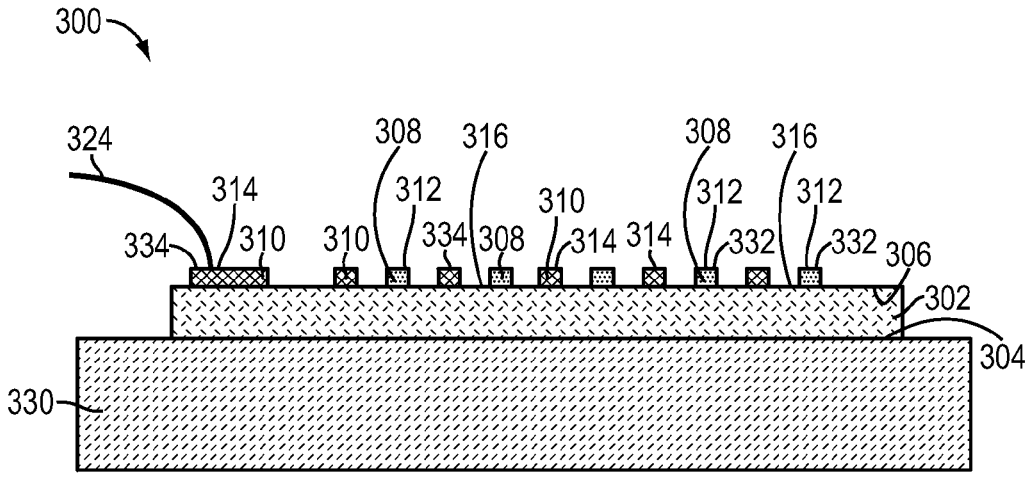
FIGS. 3A and 3B show side and top views, respectively, of another embodiment of an alkali-metal generating and absorbing device, which has two electrodes positioned on the same surface of a solid in an interdigitated pattern.
Figure 3B:
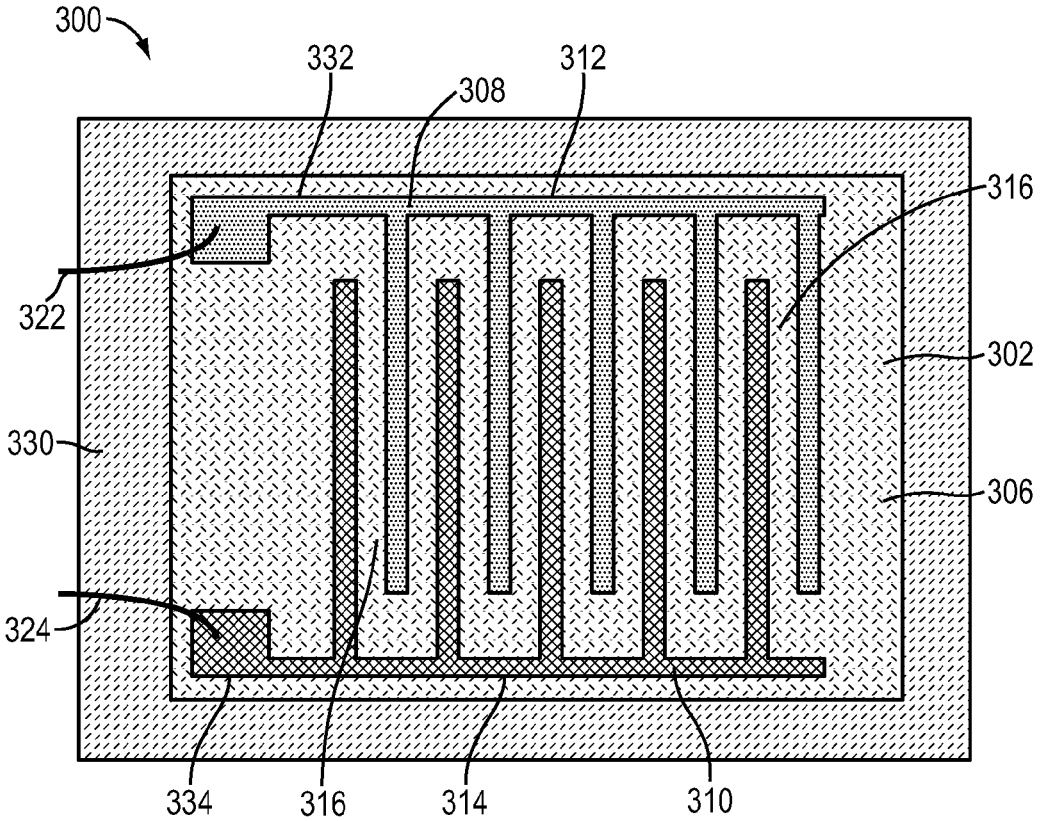

According to another embodiment of the present invention, an alkali-metal generating/absorbing device can have two electrodes positioned on the same surface of an alkali-metal-containing solid. Such an exemplary device 300 is illustrated in FIGS. 3A and 3B. A solid 302 has a bottom surface 304 and a top surface 306. A silver layer 308 and a low-mobility-metal layer 310 are positioned on the top surface 306 in an interdigitated pattern so as to form electrodes 312, 314, respectively. The low-mobility-metal layer is selected so that the electrode 314 may not be a substantial ion source into the glass. Examples of such metals are Ti, Cr, Pt, Pd, and Ni. The electrodes 312, 314 are positioned on the top surface 306 such that at least a portion 316 of the top surface 306 is not covered by the electrodes 312, 314 and, hence, may be exposed to a chamber (not shown) inside which the solid 302 and the electrodes 312, 314 may be positioned. The electrodes 312, 314 can be connected to a power supply (not shown) using the wirebonds 322, 324.

The solid 302 and the electrodes 312, 314 are positioned on a ceramic board 330. The lack of a metal layer on the bottom surface 304 allows for high-temperature sintering (i.e. bonding) of the solid 302 with a substrate such as the ceramic board 330. A frit layer may also be sintered to form a thin alkali-metal-containing solid 302. Such a bonding may provide structural strength to the device 300, and may also facilitate direct heating of the solid 302, without an intervening metal layer, so that the solid 302 can be heated efficiently.

The device 300 can be operated in a manner similar to that of device 100, as described above. In particular, the positive and negative terminals of a power supply can be connected to the electrodes 312, 314, respectively, using the wirebonds 322, 324, causing the electrodes 312, 314 to operate as an anode 332 and cathode 334, respectively. Then, with power applied, silver ions (not shown) from the anode 332 may be injected into the solid 302, causing positively charged alkali-metal ions (not shown) to be released in the solid 302. The positively charged ions are attracted toward the negatively charged cathode 334, and hence move toward the top surface 306 of the solid 302. Upon arriving at the top surface 306, an alkali-metal ion can receive an electron directly from the cathode 334 or indirectly through surface conduction, and can be converted into the corresponding atom of the alkali metal (not shown). A fraction of these atoms may then be released into the chamber through the exposed portions 316 of the top surface 306.

By reversing the polarities of the electrodes 312, 314, the device 300 can be operated as an alkali-metal absorber. In particular, the negative and positive terminals of a power supply can now be connected to the electrodes 312, 314, respectively, causing the electrodes 312, 314 to operate as cathode and anode, respectively. Then, with power applied, the positively charged silver ions within the solid 302 will be attracted toward the electrode 312 (i.e., the cathode). Because the electrode 314 is composed of a metal which does not substantially inject ions into the solid 302, a cation-denuded zone may be formed around electrodes 314 which can absorb Cs. Then, the Cs atoms within the chamber will be adsorbed on the surface 306 and may release electrons to the anode directly or through surface conduction, and be converted into $Cs^+$ ions. These ions may pass through the portions 316 of the top surface 306 of the solid 302, and be absorbed into the solid 302.

In another embodiment, in which the electrode 314 comprises or consists essentially of Cu, the device 300 can also be operated as a generator by initially connecting the positive terminal of the power supply to the copper electrode 314, and the negative terminal to the silver electrode 312. In this configuration, $Cu^+$ ions, instead of $Ag^+$ ions, will be released into the solid 302, further causing the flow of $Cs^+$ ions and their subsequent conversion into Cs atoms, as described above. By subsequently reversing the polarities of the electrodes 312, 314, the device 300 can operate as an absorber. It should be understood that each of the electrodes 312, 314 can be formed using metals other than copper or silver (e.g., gold, tin, titanium, nickel, palladium, platinum and aluminum) or alloys of metals, and that the same metal or metal alloy may be used to form both electrodes 312, 314. In these embodiments, the rate of alkali-metal absorption is generally proportional to the rate at which the alkali-metal atoms strike and stick to the surface 306 of the device, which is proportional to the pressure of the alkali-metal vapor in the chamber 140.

As described above, the rate of generation or absorption of Cs atoms (or atoms of another alkali metal of interest) is related to the magnitude of the current flow between the electrodes 312, 314, which depends on the voltage applied between the electrodes 312, 314, and the temperature of the solid 302.

Figure 4:
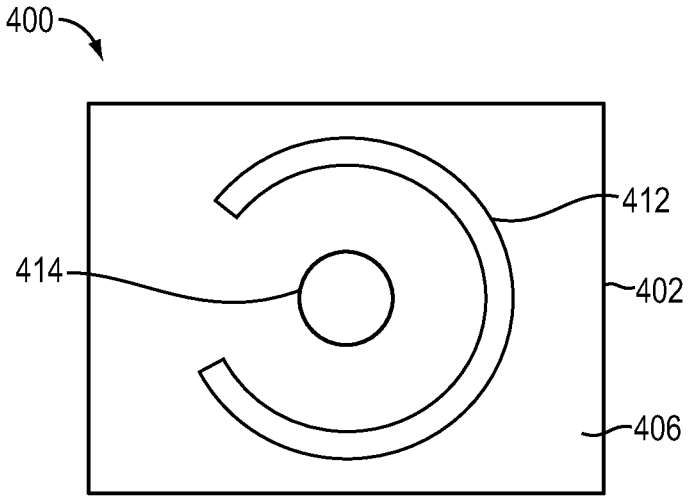
FIG. 4 shows a top view of yet another embodiment of an alkali-metal generating and absorbing device, which has two electrodes disposed in a ring-dot pattern.

In yet another embodiment, a device 400, illustrated in FIG. 4, includes two electrodes 412, 414 formed in a ring-dot pattern. The electrodes 412, 414 are positioned on a top surface 406 of an alkali-metal containing solid 402. The device 400 may be operated in a manner similar to that of device 300, as described above. Injection of metal (e.g., Ag or Cu) ions from the electrode 412, configured as anode, can sweep alkali-metal ions towards the electrode 414, configured as cathode. These ions are neutralized (i.e., converted into the corresponding elemental form) directly or indirectly by surface conduction as they approach the cathode 414.

Figure 5:
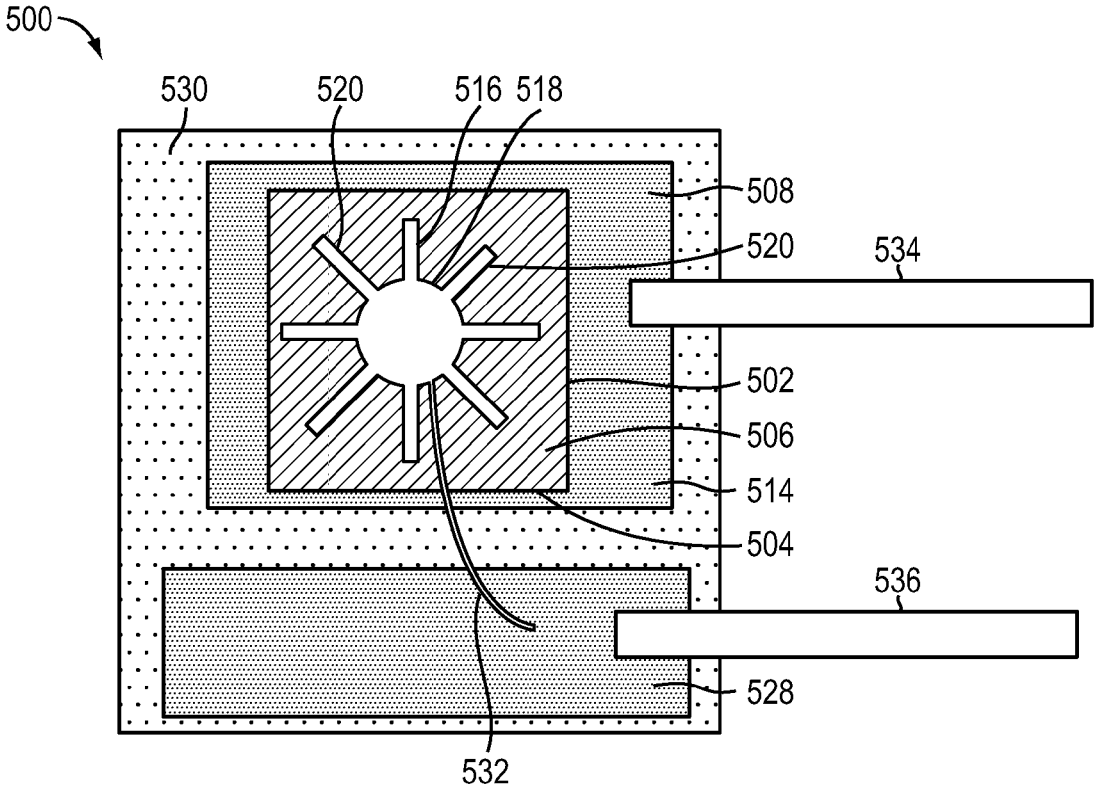
FIGS. 5 and 6 show top views of further embodiments of alkali-metal generating and absorbing devices having, respectively, an electrode disposed in a star pattern and in a mesh pattern.

In the operation of a device according to the present invention, the surface conduction of electrons can be an important parameter for the process of converting alkali-metal ions into the corresponding atoms by supplying electrons to the ions. An electrode pattern having a large perimeter (e.g., a star or interdigitated pattern) can facilitate substantial surface conduction of electrons. Therefore, in still other embodiments, the electrodes can have various other shapes. For example, in device 500, depicted in FIG. 5, an electrode 516 has a star pattern. The star pattern can include a center circle 518 and radiating fingers 520. In the embodiment shown, the electrode 516 is positioned on a top surface 506 of an alkali-metal containing solid 502, while an electrode 514 is formed as a metal layer 508 on a bottom surface 504 of the solid 502. The solid 502 and the electrodes 514, 516 are positioned on a board 530, for example a ceramic board 530. In addition, a metal layer 528 is positioned on the ceramic board 530, and the electrode 516 is connected to the metal layer 528 using a wirebond 532. The metal layers 508, 528 can be connected to a power supply (not shown) using conductors 534, 536, respectively, thereby connecting the electrodes 514, 516 to the power supply.

Figure 6:
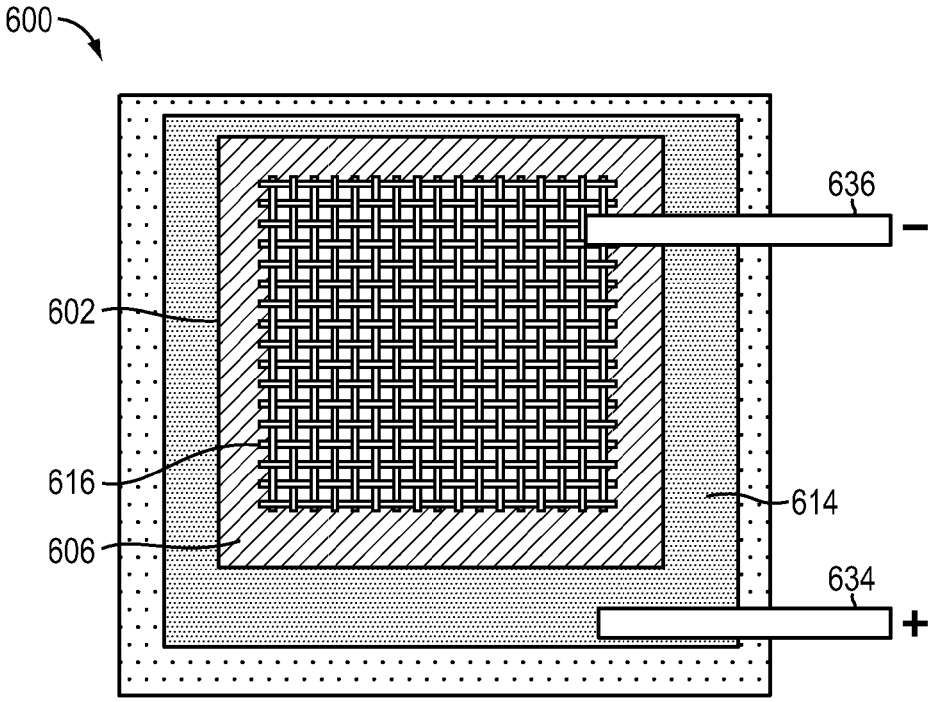

In device 600, schematically shown in FIG. 6, an electrode 616 is formed in a mesh pattern. The electrode 616 may be positioned on a top surface 606 of an alkali-metal containing solid 602 using one or more pressure clamps (not shown). Alternatively, the electrode 616 may be bonded to the solid 602 by heating the solid 602 up to a temperature slightly below the softening point of the solid 602 (which is an inherent property of the solid 602) and then by pressing the mesh electrode 616 into the solid 602. In this configuration, a conductor 634 may connect one terminal of a power supply (not shown) to an electrode 614, and a conductor 636 may directly connect the other terminal of the power supply to the mesh electrode 616. The devices 500, 600 can then be operated in a similar fashion to the device 100, as described above.

In some embodiments of the present invention, each of the two electrodes can be positioned as a substantially continuous layer upon the solid that contains the alkali metal. An advantage of this configuration is that the alkali-metal-containing solid can be protected from the atmosphere by the continuous electrodes. Thus, if the alkali-metal-containing solid is hygroscopic, it may be protected from atmospheric water except at the edges. The edges of the solid can be protected by an insulating, water impervious layer such as parylene or $Al_2O_3$ (not shown). Such a layer can be vapor deposited by known techniques such as chemical vapor deposition or atomic layer deposition (ALD). A further advantage of such an embodiment is that it may be relatively easier to position the metal electrodes over the solid as layers as opposed to positioning them in patterns.

Figure 7:
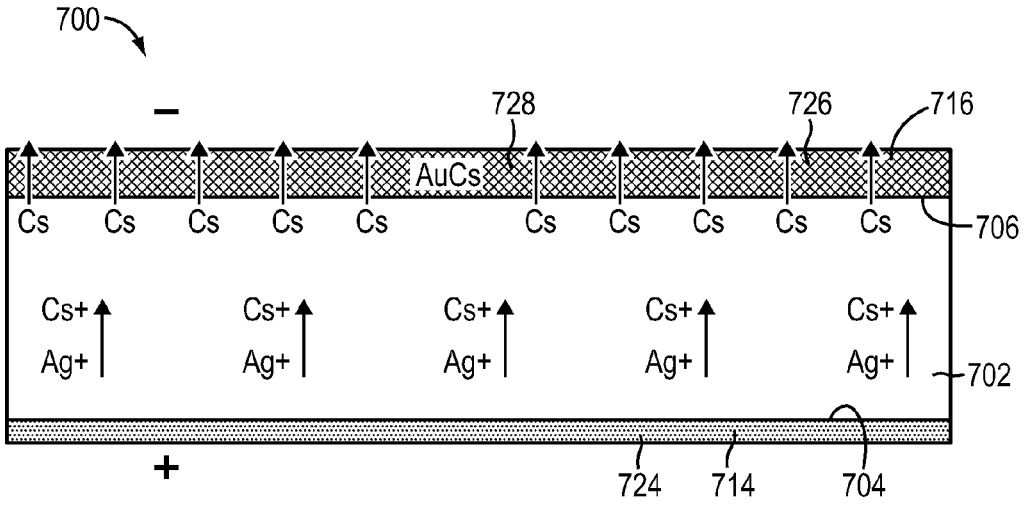
FIG. 7 schematically depicts an exemplary operation of an alkali-metal generating and absorbing device that has electrodes positioned as layers on two different surfaces of a solid.

As shown in FIG. 7, an exemplary device 700 includes a solid 702 that contains Cs. A silver (Ag) electrode 714 is positioned as a layer on a bottom surface 704 of the solid 702, and a gold (Au) electrode 716 is positioned, also as a layer, on a top surface 706 of the solid 702. The electrode 714 can be formed using another metal, such as copper, that can inject metal ions into the solid 702. In this configuration, the gold used to form the electrode 716 can react with the Cs (or another alkali metal of interest) to form an AuCs compound. Alternatively, a metal other than gold can be used to form the electrode 716, so long as the metal reacts with the alkali metal of interest contained within the solid 702 to form a compound having adequate diffusivity for the alkali metal at the temperature of operation so as to allow the alkali metal to pass therethrough.

In operation as an alkali-metal generator, the electrodes 714, 716 are configured as an anode 724 and a cathode 726, respectively. Then, with power applied, silver ions ($Ag^+$) are injected into the solid 702, which causes cesium ions ($Cs^+$) to migrate through the solid 702. The released $Cs^+$ ions move toward the cathode 726, and are converted into Cs atoms by receiving electrons in the cathode 726. These Cs atoms react with the gold electrode 716, and form the AuCs compound 728 within the cathode 726. At that point, subsequently released $Cs^+$ ions from the solid 702 are converted into Cs atoms in the cathode 726 and diffuse through the AuCs compound 728. Those Cs atoms may then be released into a chamber (not shown).

As mentioned, a metal other than gold can be used to form the electrode 716. Such a metal can be selected such that Cs (or the alkali metal of interest) has a relatively high mobility through the compound formed with the metal in the electrode 716. A very thin electrode (e.g., an electrode having a thickness of 5 nm to 500 nm) can also assist diffusional transport of alkali-metal atoms across the electrode 716.

In operation as an alkali-metal absorber, the polarities of the electrodes 714, 716 are reversed, i.e., electrode 714 is configured as a cathode and the electrode 716 is configured as an anode. In this configuration, Cs atoms in the chamber may impinge on the electrode 716, and may form the AuCs compound 728 within the electrode 716, as described above. Additional Cs atoms in the chamber may then diffuse through the AuCs compound 728, and may lose electrons to the anode (i.e., electrode 716), forming $Cs^+$ ions. These ions may then be absorbed into the solid 702.

Figure 8:
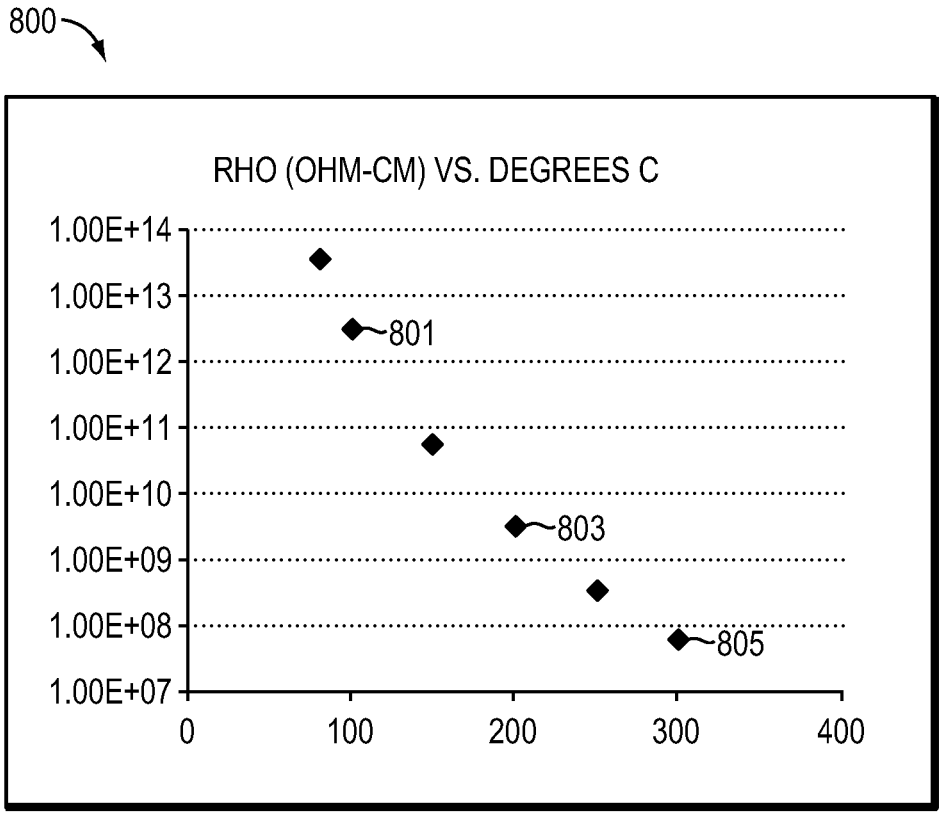
FIG. 8 shows the relationship between the resistivity and temperature of a $CsBO_3$ glass.

As mentioned above, the resistivity of an alkali-containing solid is an inherent property of the solid and its microstructure, and is also related to the temperature of the solid. FIG. 8 depicts a graph 800 showing the resistivity-temperature relationship of a $CsBO_3$ glass having a 25% mole ratio of $Cs_2O$ to $B_2O_3$ (the mole ratio is an inherent property describing the composition of a glass). As illustrated, at approximately 100° C. the resistivity of the glass is approximately $3.0\times10^{12}$ ohm-cm (see data point 801), while at approximately 200° C. the resistivity of the glass decreases to approximately $3\times10^9$ ohm-cm (see data point 803). The resistivity of the glass decreases further to approximately $5.7\times10^7$ ohm-cm when the temperature of the glass is approximately 300° C. (see data point 805).

Thus, according to the graph 800, when the temperature of an alkali-containing solid is increased, its resistivity decreases. Hence, for a certain voltage applied between the electrodes positioned substantially in contact with the alkali-containing solid, the magnitude of the current flowing through the solid increases as the temperature of the solid is increased, thereby increasing the rate of generation or absorption of alkali-metal atoms, as described above.

While the invention has been particularly shown and described with reference to specific embodiments, it will be understood by those skilled in the art that various changes in form and detail may be made therein without departing from the spirit and scope of the invention as defined by the appended claims. The scope of the invention is thus indicated by the appended claims and all changes that come within the meaning and range of equivalency of the claims are therefore intended to be embraced.

What is claimed is:

1. A device for generating an alkali metal in elemental form, the device comprising:

an alkali-containing solid containing the alkali metal in a non-elemental form;

a heater for heating the alkali-containing solid to a temperature of no more than 300° C.;

first and second solid metal electrodes positioned in contact with at least one surface of the alkali-containing solid, at least a portion of the at least one surface of the alkali-containing solid being exposed to a surrounding environment, at least one of the electrodes being an ion-injecting metal electrode; and electrical interconnects coupled to the first and second solid metal electrodes for interfacing with a driver that applies a voltage between the first and second solid metal electrodes to move ions of the alkali metal through the alkali-containing solid, at least a portion of the ions being converted into elemental form upon reaching one of the solid metal electrodes and thereafter vaporizing in the elemental form from the exposed portion of the at least one surface of the alkali-containing solid into the surrounding environment.

2. The device of claim 1, wherein the alkali-containing solid is selected from the group consisting of a glass, a glass-ceramic, a multi-phase glass, a compound, a mixture, and a crystalline solid.

3. The device of claim 1, wherein the metals of the first and second solid metal electrodes are different.

4. The device of claim 1, wherein the at least one surface comprises:

a top surface of the alkali-containing solid, the first solid metal electrode being in contact therewith; and a bottom surface of the alkali-containing solid, the second solid metal electrode being in contact therewith.

5. The device of claim 4, wherein the second solid metal electrode is disposed as a layer on the bottom surface.

6. The device of claim 4, wherein the first solid metal electrode is disposed in a pattern selected from the group consisting of a finger pattern, an interdigitated pattern, a ring-dot pattern, a mesh pattern, and a star pattern.

7. The device of claim 4, wherein the first solid metal electrode is disposed as a layer on the top surface.

8. The device of claim 1, wherein the at least one surface is a single surface, the first and second solid metal electrodes being disposed thereupon in a pattern.

9. The device of claim 8, wherein the pattern is an interdigitated pattern.

10. The device of claim 8, wherein the pattern is a ring-dot pattern.

11. The device of claim 1, further comprising a chamber enclosing the alkali-containing solid and the first and second solid metal electrodes.

12. The device of claim 11, wherein the chamber is a vacuum chamber.

13. The device of claim 11, wherein the chamber contains an inert gas.

14. The device of claim 1, wherein the alkali metal is selected from the group consisting of sodium, potassium, rubidium, cesium, and francium.

15. The device of claim 1, wherein the ion-injecting metal is selected from the group consisting of silver, copper, and gold.

* * * * *